US007148866B2

(12) United States Patent
Jun

(10) Patent No.: US 7,148,866 B2
(45) Date of Patent: Dec. 12, 2006

(54) LIQUID CRYSTAL DISPLAY APPARATUS AND A METHOD OF CONTROLLING THE SAME

(75) Inventor: Sung-gon Jun, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 255 days.

(21) Appl. No.: 10/190,734

(22) Filed: Jul. 9, 2002

(65) Prior Publication Data

US 2003/0117350 A1 Jun. 26, 2003

(30) Foreign Application Priority Data

Dec. 20, 2001 (KR) ..... 2001-81953

(51) Int. Cl.
*G09G 3/36* (2006.01)

(52) U.S. Cl. ..... 345/87; 345/98; 345/100

(58) Field of Classification Search ..... 345/87, 345/98–100, 104, 204
See application file for complete search history.

(56) References Cited

U.S. PATENT DOCUMENTS 4,800,376 A * 1/1989 Suga et al. ..... 345/1.3
5,021,775 A 6/1991 Babin ..... 345/213
5,270,696 A * 12/1993 Shin et al. ..... 345/204
6,603,468 B1 * 8/2003 Ooishi et al. ..... 345/204
6,621,478 B1 * 9/2003 Sakaguchi et al. ..... 345/98
2001/0013850 A1 * 8/2001 Sakaguchi et al. ..... 345/87

FOREIGN PATENT DOCUMENTS

| | | |
|---|---|---|
| JP | 3-83019 | 4/1991 |
| JP | 5-61435 | 3/1993 |
| KR | 1998-025131 | 7/1998 |
| KR | 1999-33178 | 5/1999 |

OTHER PUBLICATIONS

Office Action issued by the Korean Intellectual Property Office on Oct. 29, 2003 in Korean Patent Application No. 10-2001-0081953.

* cited by examiner

*Primary Examiner*—Jimmy H. Nguyen
(74) *Attorney, Agent, or Firm*—Staas & Halsey LLP

(57) ABSTRACT

A liquid crystal display (LCD) apparatus and method of controlling the same equipped with an image processor and a liquid crystal panel having a matrix array formed with liquid crystal pixels to display video data processed by the image processor on a screen includes liquid crystal pixel drivers connected in series. Driver arrays drive the liquid crystal pixel drivers. A timing controller converts the video data into serial data bit streams and transmits the serial data bit streams to the driver arrays, so that the driver arrays control each liquid crystal pixel driver to receive the serial data bit streams respectively.

19 Claims, 5 Drawing Sheets

LIQUID CRYSTAL DISPLAY APPARATUS AND A METHOD OF CONTROLLING THE SAME

CROSS-REFERENCE TO RELATED APPLICATIONS

This application claims the benefit of Korean Application No. 2001-64548, filed Oct. 19, 2001, in the Korean Patent Office, the disclosure of which is incorporated herein by reference.

BACKGROUND OF THE INVENTION

1. Field of the Invention

The present invention relates to liquid crystal display (LCD) apparatuses, allowing data supplied to a liquid crystal pixel driver of a liquid crystal panel to be transmitted in series and a method of controlling the same.

2. Description of the Related Art

Generally, an LCD apparatus for a computer includes an analog/digital (AD) converter, a scaler, a timing controller and a liquid crystal panel. The AD converter converts red, green, and blue (RGB) image signals received from a video card installed on a computer motherboard into digital signals. The scaler adjusts the RGB image signals digitalized by the AD converter adaptively to a size of the liquid crystal panel. The timing controller converts video data based on the RGB image signals and horizontal and vertical (H/V) sync signals into timing signals to display the converted view signals on the panel and outputs the timing signals. The liquid crystal panel is driven according to the video data, a clock signal, and a control signal transmitted from the timing controller.

The liquid crystal panel is equipped with an array board forming thereon a matrix array. The matrix array includes a plurality of pixel electrodes and a liquid crystal pixel driver provided in the array board to supply pixel data signals to signal lines of the pixel electrodes. The liquid crystal pixel driver drives liquid crystal pixels by voltage control, which includes a gate driver driving pixels in a vertical line of the liquid crystal panel and a source driver driving pixels in a horizontal line.

Here, the gate driver includes a plurality of driver ICs 53 horizontally arrayed as shown in FIG. 5. On each driver IC 53 a plurality of registers are formed storing therein the video data to be displayed on the liquid crystal panel 51, a power source line (VDD), a ground line (GND), a data line (DATA), and a control signal line (CNT). The converted video signals and the control signal transmitted from the timing controller 55 are transmitted to each gate driver IC through a plurality of signal input lines 57 in a parallel manner.

To connect the timing controller 55 and the plurality of the driver ICs 53 in parallel, a multiplicity of connection lines are required. For example, in a case where eight 8-bit driver ICs are used to allow a screen of extended graphics array (XGA) (1024×768) to be displayed, 8×(8×3×2+9+8+2)=536 connection lines are required. A number of connection lines is calculated using a number of driver ICs×(the number of 8-bit×R, G, B×data transmission lines+horizontal/vertical sync signal line+enable line+power source line+ground line).

As described above, connecting the signal lines to each of the driver ICs 53 becomes difficult if the timing controller 55 is connected to the plurality of the driver ICs 53 in parallel. A horizontal enlargement of a screen requires the addition of driver ICs, and thus, the number of connection lines increases, which becomes inconvenient.

SUMMARY OF THE INVENTION

The present invention has been made keeping in mind the above-described shortcomings, and an object of the present invention is to provide an LCD apparatus allowing a number of signal lines to be remarkably reduced by connecting in series a plurality of drivers controlling a voltage of liquid crystal pixels.

To achieve the above and other objects, the present invention may be accomplished by providing a liquid crystal display (LCD) apparatus equipped with an image processor and a liquid crystal panel having a matrix array formed with liquid crystal pixels to display video data processed by the image processor on a screen, including: liquid crystal pixel drivers connected in series; driver arrays driving the liquid crystal pixel drivers; and a timing controller converting the video data into serial data bit streams and transmitting the serial data bit streams to the driver arrays, so that the driver arrays control each liquid crystal pixel driver to receive the serial data bit streams respectively.

The liquid crystal pixel driver includes a by-pass set-up register and each of the serial data bit streams includes a by-pass set-up bit stream to set up the by-pass set-up register to allow respective data to be stored in the corresponding liquid crystal pixel driver. The liquid crystal pixel driver includes a clock signal line, a word signal line distinguishing a word unit, a command code and a command data unit of the serial data bit stream, a data signal line, and a command/data selection signal line to select a command data or the video data for the respective serial data bit stream inputted into the data signal line. The timing controller selects the command/data selection line of each of the liquid crystal pixel drivers to allow the command to be inputted, and determines a data bit stream from the data signal line according to a signal level of "high" or "low" of the word signal line as the command code or the command data.

The timing controller selects the command/data selection line of each of the liquid crystal pixel drivers to allow the data to be inputted, and determines a data bit stream from the data signal line according to a signal level of "high" or "low" of the word signal line as an RGB video data. In a case where a by-pass bit is established in the by-pass set-up register of each of the liquid crystal pixel drivers, the data bit stream is transmitted into an adjacent liquid crystal pixel driver. Further, each of the liquid crystal pixel drivers is a gate driver to select a column line of the matrix array.

To achieve the above and other objects, the present invention may be accomplished by providing a method of transmitting serial data in a liquid crystal display (LCD) apparatus including an image processor and a liquid crystal panel having at least one liquid crystal pixel driver driving a matrix array formed with liquid crystal pixels to display video data processed by the image processor on a screen, including: converting the video data into serial data bit streams assigned to each of the liquid crystal pixel drivers; setting up a signal input line including a command/data selection line, a word line, and a data line of the corresponding liquid crystal pixel driver; determining whether the serial data bit streams to be inputted through the data line are a command data or video data; setting up signal levels for the command/data selection line and the word line according to the determination; and transmitting the serial data bit streams including information on setting up the corresponding liquid crystal pixel driver according to the signal levels of the command/data selection line and the word line.

These together with other objects and advantages, which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENTS

Figure 1:
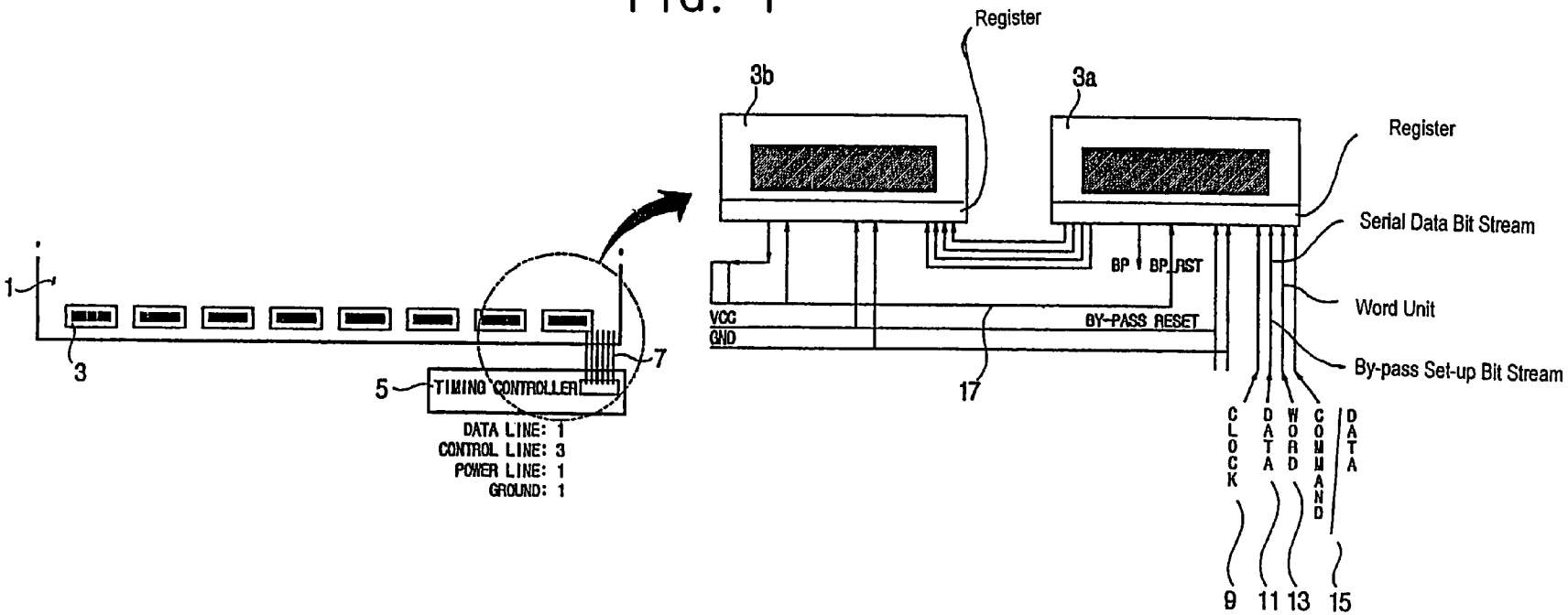
FIG. 1 is a block diagram showing a connection structure of gate drivers and a timing controller of an LCD apparatus according to an embodiment of the present invention.
Figures 2A, 2B, 2C, 2D:
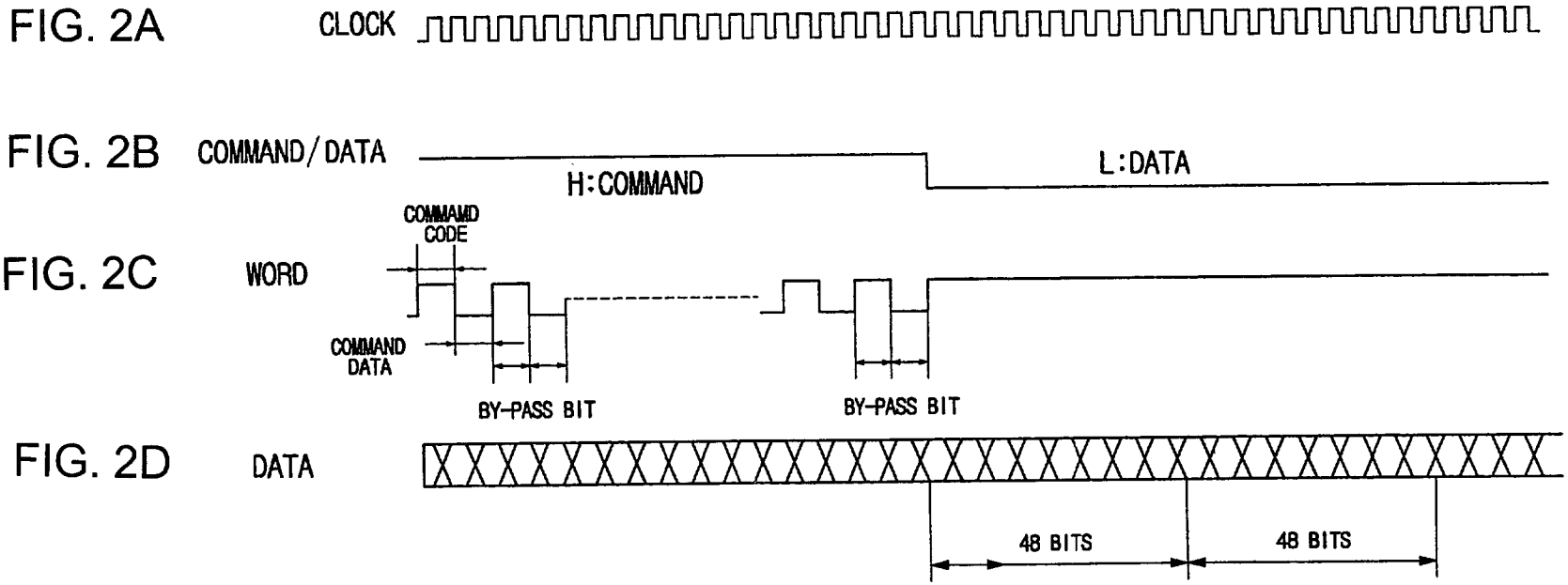
FIGS. 2A through 2D are timing graphs of each signal line of the gate drivers of FIG. 1.

FIG. 1 is a block diagram showing a connection structure of gate drivers and a timing controller of an LCD apparatus according to an embodiment of the present invention. As illustrated in FIG. 1, gate drivers 3, to select pixels in a vertical line, are horizontally arrayed on the LCD apparatus. An output line of a first gate driver 3*a* at a rightmost of the LCD apparatus is connected to an input line of a second gate driver 3*b* adjacent to the first gate driver 3*a*. An output line of the second gate driver 3*b* is connected to an input line of a third gate driver (whose reference numeral is not shown in the figures) adjacent to the second gate driver 3*b*. Accordingly, the gate drivers 3 are connected in series, forming a driver array.

Of the gate drivers 3, the rightmost first gate driver 3*a* is directly connected to a timing controller 5 outputting video data, through signal input lines 7. Thus, on the first gate driver 3*a* a clock line 9, a data line 11, a word line 13 and a command/data selection line 15 are connected. A power source signal and a ground signal are connected to a power source signal line (VCC) and a ground line (GND), respectively, at one end and to each of the gate driver 3 at another end.

The clock line 9 is a signal line allowing an output signal of the timing controller 5 to be synchronized with an inner clock signal of each of the gate driver 3. The data line 11 is a signal line into which a video data signal converted into a bit stream is inputted. The word line 13 is a signal line to distinguish a word unit, a command code, and a data unit of a command for each video signal. The command/data selection line 15 is a signal line to distinguish whether data currently supplied to the gate drivers 3 is for command data or for video data.

The command data controls the gate drivers 3. The command for each video signal may include a maximum number of data (Max. # of Data), a bit number of data (# of Bit), and/or gamma data (1, 2, 3, 4, . . . n) to adjust the size of video signals.

According to the present invention, a by-pass bit output terminal (BP) to be described below is provided from the gate drivers 3. The by-pass bit output terminal (BP) is a terminal transmitting inputted data to the gate drivers adjacent to each other, in sequence. The by-pass bit output terminal (BP) of a final gate driver (the second gate driver 3*b* in this instance) is connected to a by-pass reset input terminal (BP_RST), for each of the gate drivers 3, forming a by-pass reset line 17.

In each gate driver 3, registers are provided temporarily storing therein the video data to drive liquid crystal pixels. According to the present invention, the timing controller 5 provides a serial data bit stream, which is transmitted to each gate driver 3 on which the registers store therein respective video data. Each gate driver 3 includes a by-pass set-up register receiving respective data bit stream and a counter (not shown) counting a number of bits of the data stored in the data bit stream inputted.

FIGS. 2A through 2D are timing graphs of each signal line of the gate driver of FIG. 1. The graphs indicate whether the signal applied through the data line 11 is the command data or the video data according to a state (high or low) of a signal from the command/data selection line 15. The graphs also indicate whether, when the signal of the command/data selection line 15 is at a "high" state, the signal applied through the data line 11 is the command code or the command data according to the state (high or low) of the signal from the word line 13. "High" state and "Low" state outputted into each signal line to distinguish data can vary depending upon a signal format in the timing controller 5.

Figure 3:
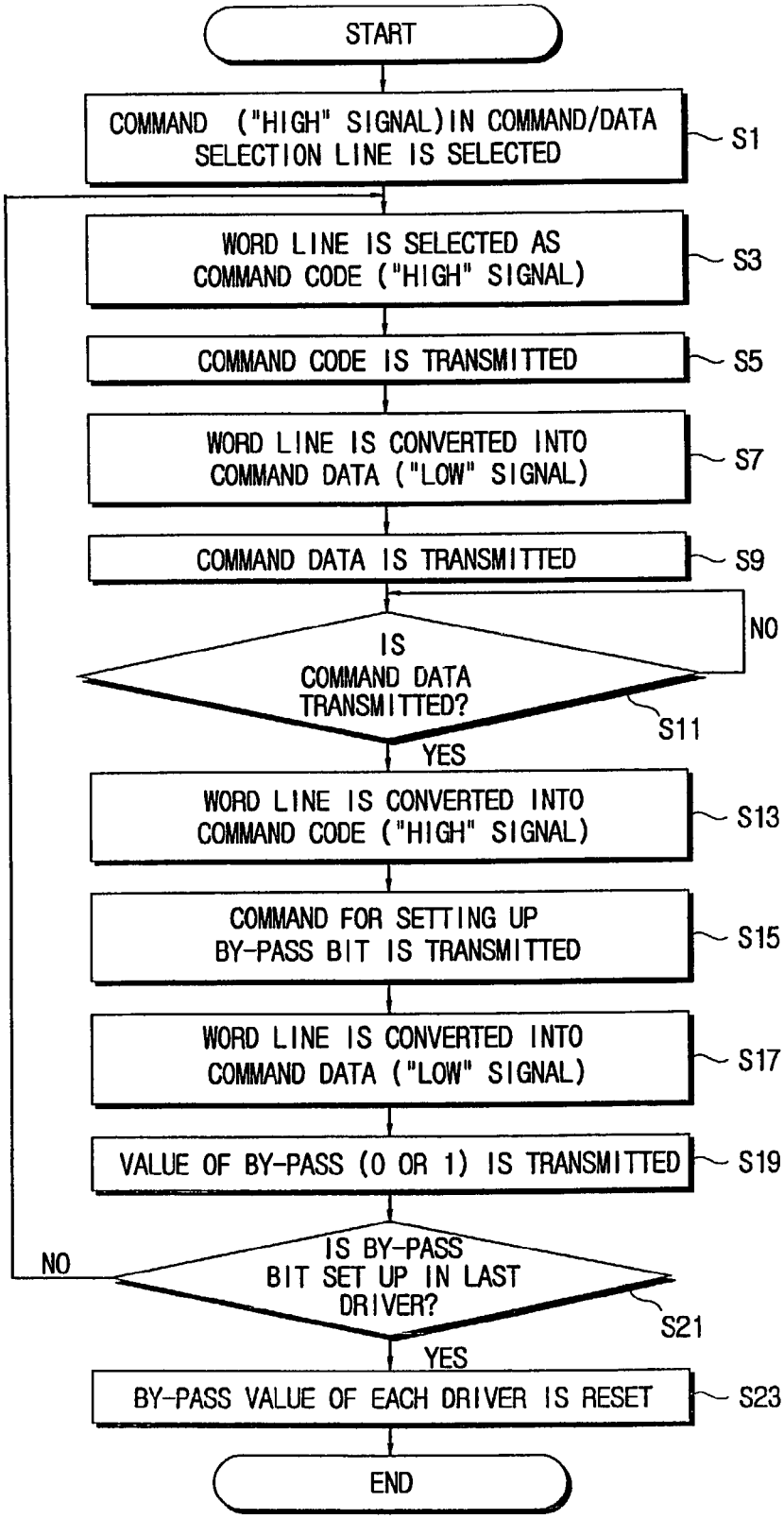
FIG. 3 is a flow chart showing a sequence of a command being inputted into one of the gate driver in the LCD apparatus of FIG. 1.

FIG. 3 is a flow chart showing a sequence of commands inputted into the gate drivers 3 in the LCD apparatus according to the present invention. A method of supplying the control signal and the data signal into the clock line 9, the data line 11, the word line 13 and the command/data selection line 15 to store respective data in each gate driver 3 will be described hereinafter.

The timing controller 5 outputs a command to the gate drivers 3. At operation S1, the command/data selection line 15 sets the command code ("high" signal). At operation S3, the word line 13 sets the command code ("high" signal). At operation S5, a bit stream inputted through the data line 11 indicates the command code. At operation S7, the word line 13 is converted into the command data ("low" signal). At operation S9, the bit stream being transmitted through the data line 11 indicates the command data necessary for the command inputted just before. For example, if the command code indicates a bit number (# of Bit), the bit stream inputted through the data line 11 is the command data indicating whether the bit number is 6-bit or 8-bit. Thus, the bit number of the register within the gate drivers 3 is set 6-bit or 8-bit.

At operation S11, a determination is made as to whether the transmission of the command data of the first gate driver is completed to set-up the next gate driver. At operation S13, if the transmission of the command data is completed, the word line 13 is again converted into a command code ("high" signal). At operation S15, the command code associated with the set-up of a by-pass bit is transmitted as the final command for setting up the current driver. At operation S17, the word line 3 is converted into a command data ("low" signal). At operation S19, a by-pass bit value ("1") is transmitted into the data line 11 as the command data. If the command is inputted again, the command is transmitted to the next driver.

Setting-up of the by-pass bit means that signals such as the clock signal, the data signal, the command signal, the word signal, etc., currently inputted are not used in the current gate driver, and the current gate driver simply plays a role of a buffer. For example, in a case where there are eight gate drivers, data is stored in a fifth gate driver if the command is inputted after setting up by-pass bits of first, second, third, and fourth gate drivers.

Operations S3 to S19 are repeated in a same manner until the by-pass bit of the final gate driver is set-up. At operation S21, if the by-pass bit is set up in the final gate driver, a by-pass bit output of the final gate driver is fed back to each of the gate drivers through the by-pass reset line 17, allowing, at operation S23, the by-pass bit of all of the gate drivers to be reset. In this manner, the setting-up can be repeated from the first gate driver.

Figure 4:
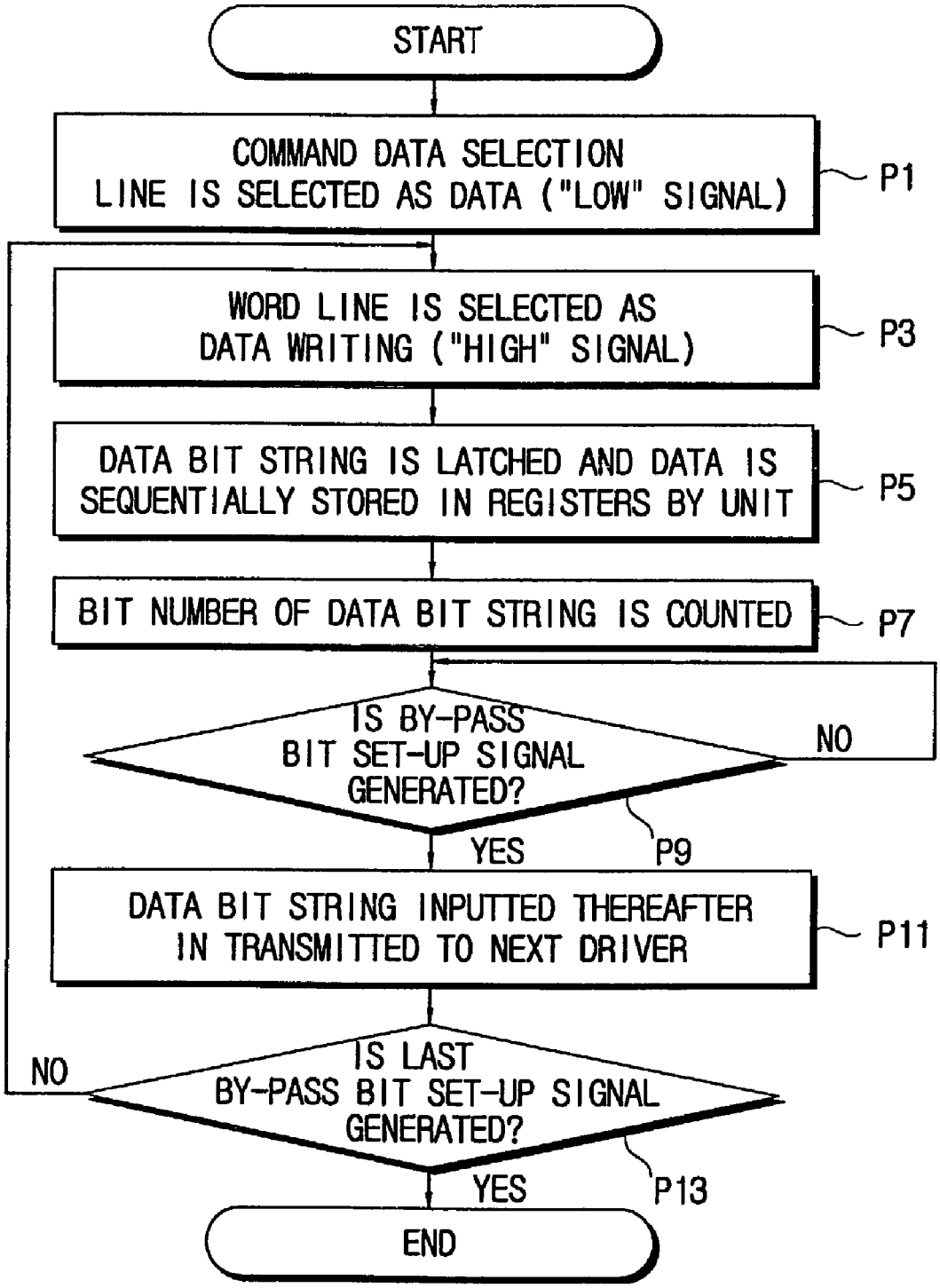
FIG. 4 is a flow chart showing a sequence of data being inputted into one of the gate driver in the LCD apparatus of FIG. 1.
Figure 5:
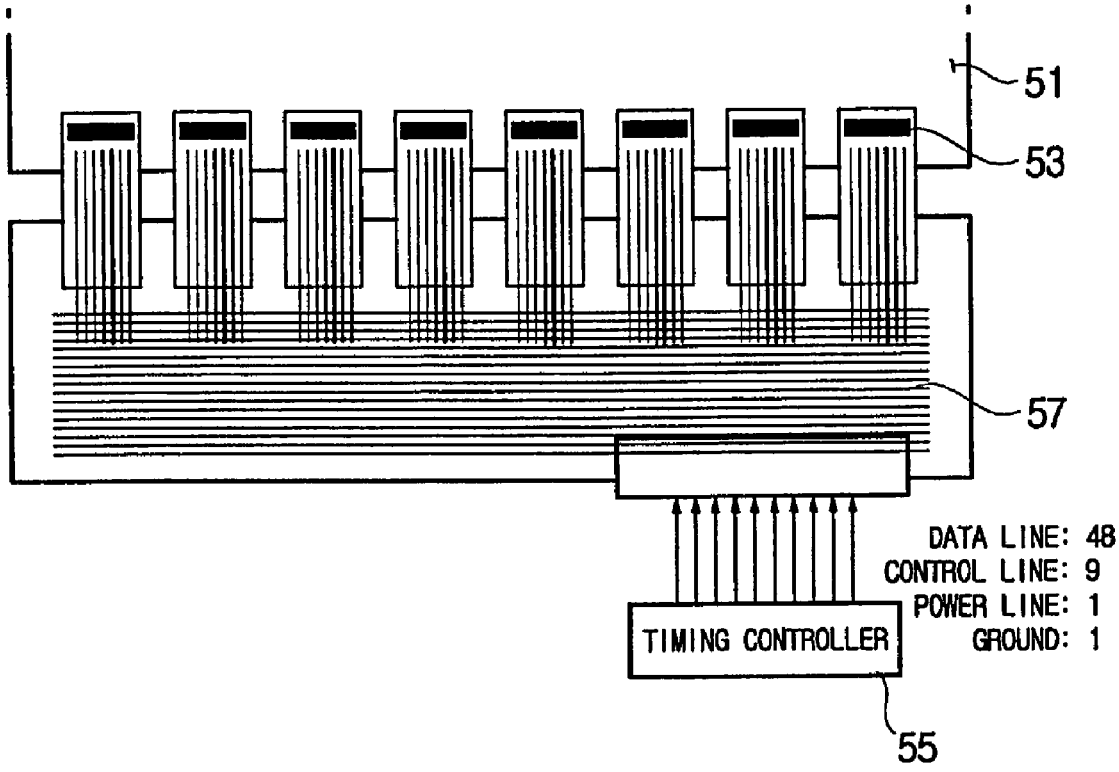
FIG. 5 (PRIOR ART)
FIG. 5 a block diagram showing a connection structure of the gate drivers and a timing controller in a conventional LCD apparatus.

FIG. 4 is a flow chart showing a sequence of data being inputted into the gate drivers 3 in the LCD apparatus, according to the present invention. In a case of inputting video data, at operation P1, the command/data selection line 15 is selected as data ("low" signal). At operation P3, the word line 13 is selected as data writing ("high" signal). At operation P5, data bit streams are transmitted through the data line 11 and a bit stream unit is stored in a register of each gate driver in sequence. At operation P7, a bit number of the bit streams stored simultaneously is counted by the counter provided within the gate driver. At operation P9, if data is stored in the last register of each gate driver, a by-pass bit set-up signal within the gate driver is generated. Therefore, at operation P11, bit streams inputted after the by-pass bit set-up signal has been generated are not inputted in the current gate driver, but passed to the next gate driver. At operation P13, until the last data unit is stored in the last gate driver from operations P5 to P11, video data is stored in corresponding registers of each gate driver.

With the above sequences, the control signal and the data signal supplied to one of the gate drivers are transmitted in sequence to the adjacent gate driver, allowing video data to be stored in the registers of each gate driver. In the embodiment described above, a serial data bit stream including therein the by-pass bit set-up command is transmitted to each liquid crystal pixel driver. If an ID is provided to a liquid crystal pixel driver and a unit to recognize the ID is provided in each liquid crystal pixel driver, and the serial data having ID information is transmitted, each gate driver is allowed to store therein respective data based on the ID information.

As described above, according to the present invention, a liquid crystal display apparatus is provided allowing a plurality of drivers controlling voltage of liquid crystal pixels to be connected in series, thereby remarkably reducing a number of signal lines.

Although the preferred embodiments of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A liquid crystal display (LCD) apparatus equipped with an image processor and a liquid crystal panel having a matrix array formed with liquid crystal pixels to display video data processed by the image processor on a screen, comprising:

a driver array having liquid crystal pixel drivers connected in series, the driver array driving the liquid crystal pixel drivers; and a timing controller converting the video data into respective serial data bit streams for each liquid crystal pixel driver and transmitting the serial data bit streams to the driver array, so that the driver array controls each liquid crystal pixel driver to receive the respective serial data bit streams, wherein each of the liquid crystal pixel drivers comprises:

a by-pass bit output terminal transmitting inputted data to the liquid crystal drivers adjacent to each other in sequence, and the by-pass bit output terminal of a final liquid crystal driver is connected to a by-pass reset input terminal of each of said liquid crystal drivers, forming a by-pass reset line, so that a by-pass bit of each of said liquid crystal drivers can be reset when said by-pass bit is set up in said final liquid crystal driver and said final liquid crystal driver outputs a by-pass bit output to said by-pass reset input terminal of each of said liquid crystal drivers, and a by-pass set-up register receiving said respective serial data bit stream, and wherein each of the serial data bit streams comprises a by-pass set-up bit stream to set up the by-pass set-up register to allow respective data to be stored in the corresponding liquid crystal pixel driver.

2. The LCD apparatus according to claim 1, wherein each of the liquid crystal pixel drivers comprises a clock signal line, a word signal line distinguishing a word unit, a data signal line, and a command/data selection signal line to select a command data or the video data for the respective serial data bit stream inputted into the data signal line.

3. The LCD apparatus according to claim 2, wherein the timing controller outputs a command code or command data to the liquid crystal pixel drivers via the command/data selection line of each of the liquid crystal pixel drivers, and wherein the command code or the command data is a data bit stream from the data signal line according to a signal level of "high" or "low" of the word signal line.

4. The LCD apparatus according to claim 3, wherein, when a by-pass bit is established in the by-pass set-up register of each of the liquid crystal pixel drivers, the data bit stream is transmitted into an adjacent liquid crystal pixel driver.

5. The LCD apparatus according to claim 2, wherein the timing controller outputs a command code or command data to the liquid crystal pixel drivers via the command/data selection line of each of the liquid crystal pixel drivers, and wherein a data bit stream from the data signal line according to a signal level of "high" or "low" of the word signal line is an RGB video data.

6. The LCD apparatus according to claim 5, wherein, when a by-pass bit is established in the by-pass set-up register of each of the liquid crystal pixel drivers, the data bit stream is transmitted into an adjacent liquid crystal pixel driver.

7. The LCD apparatus according claim 2, wherein the clock signal line is a signal line allowing an output signal of the timing controller to be synchronized with an inner clock signal of the corresponding liquid crystal pixel driver.

8. The LCD apparatus according claim 2, wherein the data line is a signal line into which the video data converted into the serial data bit streams is inputted.

9. The LCD apparatus according claim 2, wherein the word line is a signal line to distinguish the word unit, the command code, and the command data unit for each video data.

10. The LCD apparatus according claim 2, wherein the command/data selection line is a signal line to distinguish whether data currently supplied to the liquid crystal pixel drivers is for the command data or for the video data.

11. The LCD apparatus according claim 1, wherein each of the liquid crystal pixel drivers is a gate driver to select a column line of the matrix array.

12. A method of transmitting serial data in a liquid crystal display (LCD) apparatus comprising an image processor and a liquid crystal panel having at least one liquid crystal pixel driver driving a matrix array formed with liquid crystal pixels to display video data processed by the image processor on a screen, comprising:

converting the video data into respective serial data bit streams assigned to each of the liquid crystal pixel drivers;

setting up a signal input line comprising a command/data selection line, a word line, and a data line of the corresponding liquid crystal pixel driver;

determining whether the serial data bit streams to be inputted through the data line are a command data or video data;

setting up signal levels for the command/data selection line and the word line according to the determination; and transmitting the serial data bit streams comprising information on setting up the corresponding liquid crystal pixel driver according to the signal levels of the command/data selection line and the word line;

wherein each of the liquid crystal pixel drivers comprises:

a by-pass bit output terminal transmitting inputted data to the liquid crystal pixel drivers adjacent to each other in sequence, and the by-pass bit output terminal of a final liquid crystal pixel driver is connected to a by-pass reset input terminal of each of said liquid crystal drivers, forming a by-pass reset line, so that a by-pass bit of each of said liquid crystal drivers can be reset when said by-pass bit is set up in said final liquid crystal driver and said final liquid crystal driver outputs a by-pass bit output to said by-pass reset input terminal of each of said liquid crystal drivers, and a by-pass set-up register receiving said respective serial data bit stream, and wherein each of the serial data bit streams comprises a by-pass set-up bit stream to set up the by-pass set-up register to allow respective data to be stored in the corresponding liquid crystal pixel driver.

13. The method according to claim 12, wherein when the serial data bit streams to be inputted through the data line are the command, the setting up of the signal levels comprises:

setting up the command/data selection line for the command data, and setting up the word line for a command code, and where the transmitting of the serial data bit streams further comprises transmitting the serial data bit streams having the command data through the data line.

14. The method according to claim 13, wherein the serial data bit streams transmitted through the data line comprise the command code related to a bypass bit to set a next liquid crystal pixel driver adjacent to the liquid crystal pixel driver being set by setting up the word line for the command code.

15. The method according to claim 14, further comprising:

setting up the word line for the command data input when the bypass bit is transmitted through the data line.

16. The method according to claim 12, further comprising:

setting up the word line of an input of the command data; and transmitting the serial data bit streams having the command data through the data line.

17. The method according to claim 12, wherein when the data bit streams to be inputted through the data line comprise the video data, the setting up of the signal levels comprises:

selecting the command/data selection line for the video data; and setting up the word line to write data.

18. The method according to claim 17, further comprising:

sequentially storing the serial data bit streams transmitted through the data line in an inner register of the liquid crystal pixel driver.

19. The method according to claim 17, further comprising:

simultaneously counting a bit number with the serial data bit streams stored;

generating a bypass bit set-up signal after storing the serial data bit streams in the liquid crystal pixel driver; and transmitting the data bit streams to the next adjacent liquid crystal pixel driver when the bypass bit set-up signal is generated.

* * * * *